US012402769B2

(12) United States Patent
Bian et al.

(10) Patent No.: US 12,402,769 B2
(45) Date of Patent: Sep. 2, 2025

(54) WET-AND-DRY FLOOR BRUSH FOR VACUUM CLEANER

(71) Applicant: SEB S.A., Ecully (FR)

(72) Inventors: Zhuang Bian, Jiangsu (CN); Pierre-Louis Bodin, Vernon (FR)

(73) Assignee: SEB S.A. (FR)

( * ) Notice: Subject to any disclaimer, the term of this patent is extended or adjusted under 35 U.S.C. 154(b) by 563 days.

(21) Appl. No.: 17/618,052

(22) PCT Filed: Dec. 20, 2019

(86) PCT No.: PCT/EP2019/086591
§ 371 (c)(1),
(2) Date: Dec. 10, 2021

(87) PCT Pub. No.: WO2020/249248
PCT Pub. Date: Dec. 17, 2020

(65) Prior Publication Data

US 2022/0304537 A1 Sep. 29, 2022

(30) Foreign Application Priority Data

Jun. 12, 2019 (CN) ..... 201910504305.9
Jun. 12, 2019 (CN) ..... 201920874703.5

(51) Int. Cl.
*A47L 11/40* (2006.01)
*A47L 5/12* (2006.01)

(52) U.S. Cl.
CPC ..... *A47L 11/4083* (2013.01); *A47L 5/12* (2013.01); *A47L 11/4088* (2013.01)

(58) Field of Classification Search
CPC .. A47L 2501/01; A47L 2501/02; A47L 11/30; A47L 11/34; A47L 11/201;
(Continued)

(56) References Cited

U.S. PATENT DOCUMENTS 1,527,224 A 2/1925 Riordan
6,733,199 B2 * 5/2004 Dingert ..... A47L 13/22 401/1
(Continued)

FOREIGN PATENT DOCUMENTS

CN 1387818 A * 1/2003 ..... A47L 11/03
CN 105686771 A * 6/2016 ..... A47L 13/225
(Continued)

OTHER PUBLICATIONS

WIPO Translation DE 102006061193; Hard Floor Nozzle for Vacuum-Cleaning and Wiping of Hard Floor, Has Control Unit Permitting or Preventing Supply of Liquid to Wiper Depending on Operation of Nozzle During Operation Process of Suction of Low Pressure; Marko, Geis; Apr. 17, 2008 (Year: 2008).*
(Continued)

*Primary Examiner* — Brian D Keller
*Assistant Examiner* — Sidney D Full
(74) *Attorney, Agent, or Firm* — Lerner David LLP

(57) ABSTRACT

A wet-and-dry floor brush for a vacuum cleaner, including a floor brush body including at least one dust suction port at a bottom of the floor brush body, and a wet mopping device including a base plate for mounting a mop cloth, and a liquid supply tank located on an upper side of the base plate, the base plate including liquid discharge holes, and the liquid supply tank includes an air inlet in communication with the outside. The bottom of the liquid supply tank has a liquid outlet in fluid communication with liquid discharge holes. The liquid outlet includes a valve for opening and closing the liquid outlet, and the liquid supply tank includes an external action member, the action member and valve configured to allow the transmission of motion to open or close the liquid outlet by operating the action member.

21 Claims, 5 Drawing Sheets

(58) Field of Classification Search
CPC ..... A47L 11/408; A47L 11/4083; A47L 11/4088; A47L 13/20; A47L 13/22; A47L 13/23; A47L 13/24; A47L 13/26; A47L 13/42
See application file for complete search history.

(56) References Cited

U.S. PATENT DOCUMENTS

| | | | | |
|---|---|---|---|---|
| 11,937,752 | B2 * | 3/2024 | Shin | A47L 11/4069 |
| 2003/0051310 | A1 * | 3/2003 | Morgan | A47L 5/28 15/412 |
| 2004/0111822 | A1 * | 6/2004 | Syu | A47L 5/365 15/321 |
| 2016/0120388 | A1 * | 5/2016 | Liu | A47L 13/225 15/322 |
| 2017/0202421 | A1 * | 7/2017 | Hwang | A47L 13/26 |
| 2017/0231454 | A1 | 8/2017 | Kingma et al. | |
| 2019/0328200 | A1 * | 10/2019 | Ko | A47L 11/2025 |

FOREIGN PATENT DOCUMENTS

| | | | | |
|---|---|---|---|---|
| CN | 107072460 | A | 8/2017 | |
| DE | 102006061193 | * | 4/2008 | |
| DE | 102006061192 | A1 | 6/2008 | |
| EP | 1224899 | A2 | 7/2002 | |
| EP | 3366182 | A1 | 8/2018 | |
| JP | 58165558 | * | 9/1983 | |
| JP | 2006102052 | A | 4/2006 | |
| KR | 20100003536 | U * | 4/2010 | A47L 11/16 |
| KR | 101671116 | * | 10/2016 | A47L 11/34 |
| WO | 2008096949 | A1 | 8/2008 | |

OTHER PUBLICATIONS

PE2E Translation KR 101671116; Cleaner and Water Cleaning Device; Pyeong, Ji Heon; Oct. 31, 2016 (Year: 2016).*
Description JPS58165558A Espacenet; Air Supply Mechanism for Liquid Tank; Sep. 30, 1983 (Year: 1983).*
PE2E Translation CN-1387818; Device and Method for Cleaning Surfaces; Bauman, RW; Jan. 1, 2003 (Year: 2003).*
PE2E Translation KR-20100003536; Multi-Purpose Cleaner; Apr. 1, 2010 (Year: 2010).*
CN-105686771 Espacenet Translation; Surface Cleaning Device; Bian, Zhuang; Jun. 22, 2016 (Year: 2016).*
International Search Report for Application No. PCT/EP2019/086591 mailed Apr. 9, 2020, pp. 1-3.

* cited by examiner

WET-AND-DRY FLOOR BRUSH FOR VACUUM CLEANER

CROSS-REFERENCE TO RELATED APPLICATIONS

The present application is a national phase entry under 35 U.S.C. § 371 of International Application No. PCT/EP2019/086591 filed Dec. 20, 2019, which claims priority from Chinese Application Nos. 201910504305.9 and 201920874703.5, both filed on Jun. 12, 2019, all of which are incorporated herein by reference.

FIELD OF THE INVENTION

The present invention relates to the technical field of cleaning equipment, and in particular to a wet-and-dry floor brush for a vacuum cleaner.

BACKGROUND OF THE INVENTION

In daily life, vacuum cleaners are generally used for sucking particulate matter such as dust on floors to be cleaned, and are particularly suitable for cleaning rough floors, for example, for cleaning indoor carpets, wooden floors, etc. For the cleaning of smooth floors, such as floor tiles and ceramic tiles, cleaning mops are generally used to wipe the smooth floors with wet mop cloth to remove stains from the surface of the smooth floors. Such a cleaning approach inevitably requires a user to replace the cleaning tool multiple times to realize the cleaning operation of the surface to be cleaned, which is cumbersome to operate.

In order to solve the above-mentioned technical problem, Chinese invention patent application with the publication number of CN 107072460A discloses a floor cleaning device capable of achieving a wet cleaning function by wetting a surface to be cleaned with a liquid while collecting dust. The device is provided with a liquid containing system which comprises an outlet having a plurality of openings to allow the liquid to be drawn by a capillary force when a mop base such as cloth is mounted against the plurality of openings, and the liquid containing system is substantially closed except for the plurality of openings after filling. Since in the liquid containing system, the liquid is applied to the floor completely relying on the capillary force of the cloth, the cloth must be removed after completing the cleaning operation, otherwise the liquid will continue to be applied to the floor, causing the floor to be wet.

SUMMARY OF THE INVENTION

In order to achieve the above object of the present invention, the present invention adopts the following technical solutions:

a wet-and-dry floor brush for a vacuum cleaner, comprising:

a floor brush body provided with at least one dust suction port at the bottom; and a wet mopping device comprising a base plate for having mop cloth mounted thereto, and a liquid supply tank located on an upper side of the base plate for supplying a cleaning liquid to the mop cloth, the base plate being provided with a number of liquid discharge holes, the liquid supply tank being provided with an air inlet in communication with the outside, and the bottom of the liquid supply tank being provided with a liquid outlet in fluid communication with the liquid discharge holes; the liquid outlet is provided with a valve for opening and closing the liquid outlet, and the liquid supply tank is externally provided with an action member which is operable by a user, the action member and the valve being disposed in a manner allowing the transmission of motion such that the user is able to open or close the liquid outlet by operating the action member.

In the above technical solution, preferably, the base plate is provided with a cavity having to a volume smaller than that of the liquid supply tank, and the liquid outlet, the cavity and the number of liquid discharge holes are in communication with one another in sequence.

In a preferred embodiment, the base plate is provided with a venting pipe connecting the cavity with the liquid supply tank. The venting pipe protrudes from an upper surface of the base plate and up to higher than the maximum fill level of liquid in the liquid supply tank, so as to vent the air existing in the cavity when the liquid enters the cavity via the liquid outlet.

In a preferred embodiment, the cavity is provided with at least one internal wall which reduces the volume of the cavity and thus reduces the latency to fill the cavity with water when the drain valve is actuated to its open position. The internal walls are, for example, at least one longitudinal projection protruding inside the cavity.

In the above technical solution, preferably, the base plate has a detachable portion in which the cavity is formed.

In the above technical solution, preferably, the number of liquid discharge holes are also provided in the detachable portion.

In the above technical solution, preferably, the action member is a rotating member or a movable member.

In the above technical solution, preferably, the action member is provided at the top of the liquid supply tank.

In the above technical solution, preferably, the wet mopping device is detachably mounted to the floor brush body.

In the above technical solution, preferably, the base plate and the liquid supply tank are integrally formed.

In the above technical solution, preferably, the base plate is located at the bottom of the floor brush body, and the liquid supply tank is detachably mounted at the top of the floor brush body.

In the above technical solution, preferably, the base plate is detachably mounted at the bottom of the floor brush body.

In a preferred embodiment, the base plate is provided with at least one locking element which cooperates with a corresponding locker arranged on the floor brush body so as to lock the base plate with the floor brush body. The locking element is for example a hook. The base plate is preferably provided with two locking elements and more preferably with four. The locking elements may be integrally formed with the base plate or attached thereto.

In the above technical solution, preferably, the dust suction port is one in number and is located at a front portion of the floor brush body, and the base plate is located behind the dust suction port.

In the above technical solution, preferably, the bottom of the floor brush body is provided with a pair of dust suction ports, the pair of dust suction ports being respectively located on the front side and the rear side of the floor brush body, and the base plate is located between the pair of dust suction ports.

In the above technical solution, preferably, the top of the liquid supply tank is provided with a liquid filling port, and a tank cap is arranged at the liquid filling port, the tank cap being provided with an air inlet which communicates the outside with the interior of the liquid supply tank.

Alternatively and preferably, the top of the liquid supply tank is provided with a liquid filling port, a tank cap being arranged at the liquid filling port and comprising an air inlet open towards the interior of the liquid supply tank and an air opening open towards the outside of the liquid supply tank, the tank cap comprises a chicane shape formed by at least one baffle and forming an air inlet channel extending inside the tank cap from the air inlet to the air opening. The chicane shape constitutes an obstacle on the way from the interior of the liquid supply tank to the outside, so that water cannot leak outwards when the water tank is tilted.

In the above technical solution, preferably, the tank cap comprises a cover part and a lining part that is mounted to the cover part.

In the above technical solution, preferably, the cover part comprises said chicane shape.

In the above technical solution, preferably, at least one of the baffles is hollowed to define an intermediate air opening in the air inlet channel.

In a preferred embodiment, a cam surface is formed at a top portion of the valve plug to lock the drain valve in the closed or open position. To close the valve, the end of a lever arm of the action member should be forced to pass through the cam surface to push the valve plug in an axial direction against a spring force that tends to urge the valve plug upwards. Conversely, to open the valve, the end of the lever arm of the action member should be forced to pass through the cam surface.

In a preferred embodiment, the valve is provided with two sealings, a lower one formed by an O-ring for radial sealing and an upper one formed by a washer with axial lip for axial sealing, in order to reduce the effort needed to operate the plug of the valve.

Compared with the prior art, the present invention achieves the following beneficial effects: in the wet-and-dry floor brush of this application, a valve is provided at the liquid outlet of the liquid supply tank, and an action member for controlling the action of the valve is provided outside the liquid supply tank, such that the user can open or close the liquid outlet by operating the action member, and therefore, the user can close the liquid outlet of the liquid supply tank in a timely manner after using the floor brush to prevent the liquid from continuously flowing to the floor.

wherein: 11. Floor brush body; 111. Dust suction port; 112. Suction passage; 113. Rotary connector;

12. Wet mopping device; 121. Base plate; 122. Liquid supply tank; 123. Liquid discharge hole; 124. Cavity; 125. Liquid outlet; 126. tank cap; 127. Liquid filling port; 128. Air inlet; 129. Action member; 130. Valve; 131. Plug; 132. Spring; 133. Rotating shaft; 134. Sealing ring; 135. Check valve; 136. Mounting hole; 142. Cover part; 146. Lining part.

22. Locking element; 24. Venting pipe; 26. Internal wall; 32. Fixing hole; 33. Screw hole; 36. Chicane shape; 361. Inner skirt; 362. Ribs; 363. intermediate air opening; 364. first notch; 37. Outer skirt; 373. block; 374. second notch; 38. Air inlet; 41. Cam surface; 42. First edge; 43. Protrusion; 44. Second edge; 34. Upper sealing ring; 50. Lever arm.

DETAILED DESCRIPTION OF THE INVENTION

The technical content, structural features, achieved objects and effects of the present invention will be described in detail below with reference to the embodiments and the accompanying drawings. The positional relationships of upper, lower, left, right, front, and rear described in this embodiment correspond to the respective positional relationships shown in FIG. 1, respectively.

Figure 1:
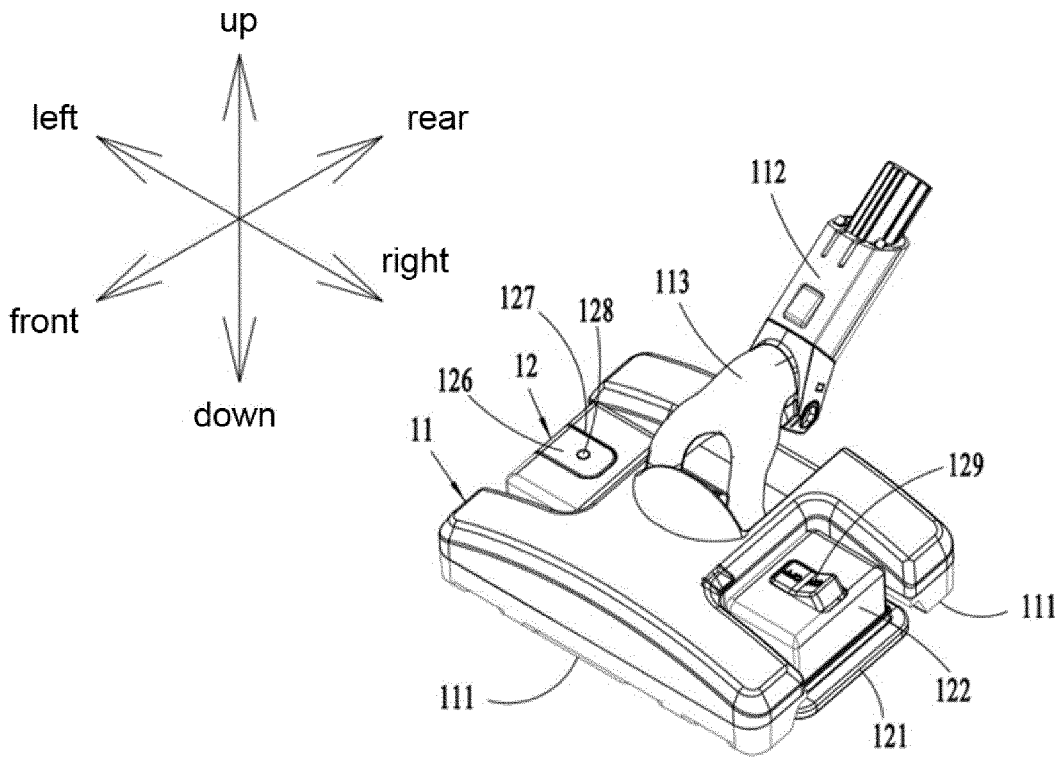
FIG. 1 is a schematic perspective view of the present invention.
Figure 2:
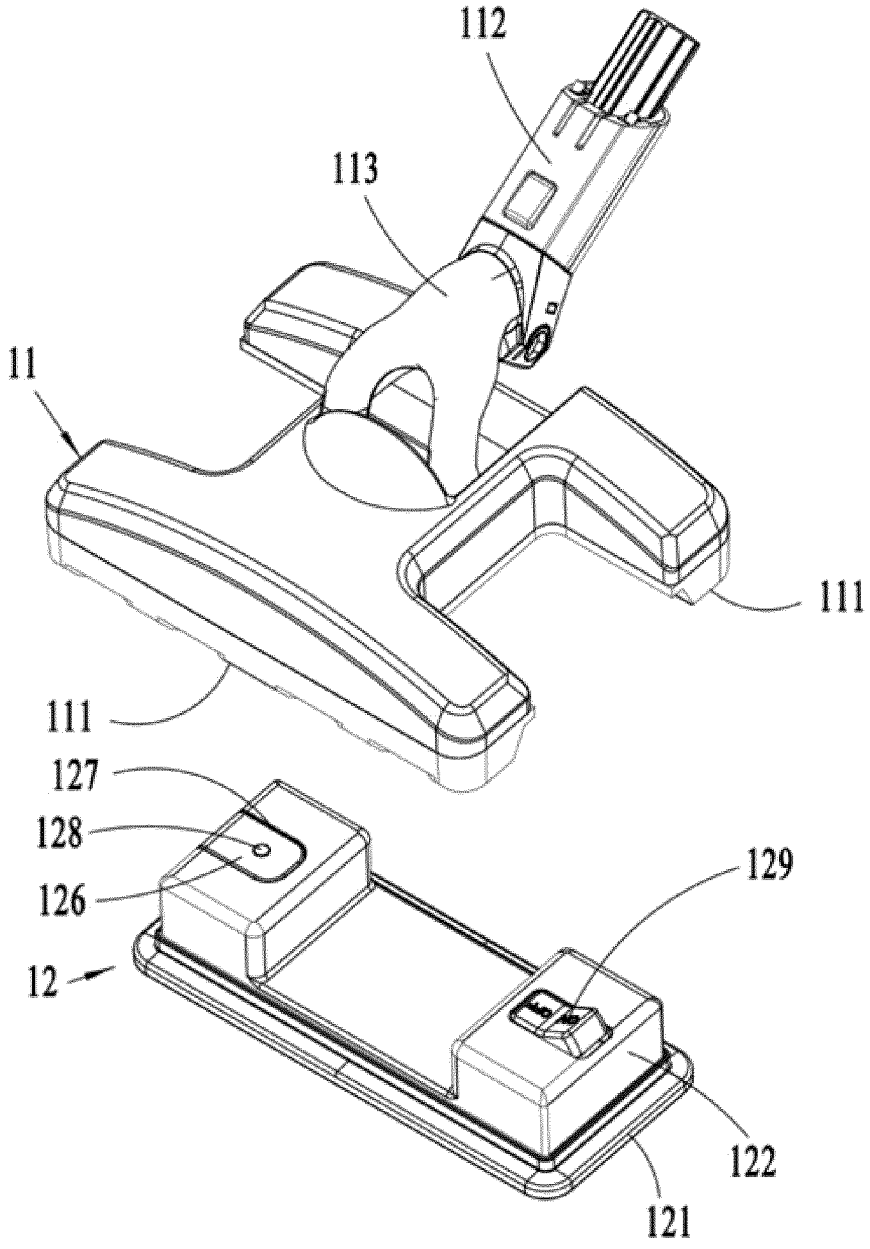
FIG. 2 is a schematic exploded view of the present invention.

As shown in FIGS. 1 and 2, a wet-and-dry floor brush comprises a floor brush body 11 movable on a floor to be cleaned, a rotary connector 113 connected to the floor brush body 11, a suction passage 112, and a wet mopping device 12 fixedly mounted to the floor brush body 11. A part of the suction passage 112 is received within the floor brush body 11, and the other part thereof is provided on the rotary connector 113. The bottom of the floor brush body 11 is provided with two dust suction ports 111 opposite in the front and rear direction. When the wet-and-dry floor brush is applied to a vacuum cleaner, the wet mopping device 12 is located between the two dust suction ports 111, and the wet-and-dry floor brush is connected to the main body portion of the vacuum cleaner via the rotary connector 113, for example, to a suction unit on the vacuum cleaner by means of a hard tube or a hose. The suction passage 112 can suck in particulate matter such as dust on the floor to be cleaned through the dust suction ports 111 by means of a suction force of the suction unit. Of course, it is also possible to provide only one dust suction port 111 at the front portion of the floor brush body 11, and the dust suction port 111 is located in front of the wet mopping device 12, that is, the function of first dusting and then mopping can be realized.

Figure 3:
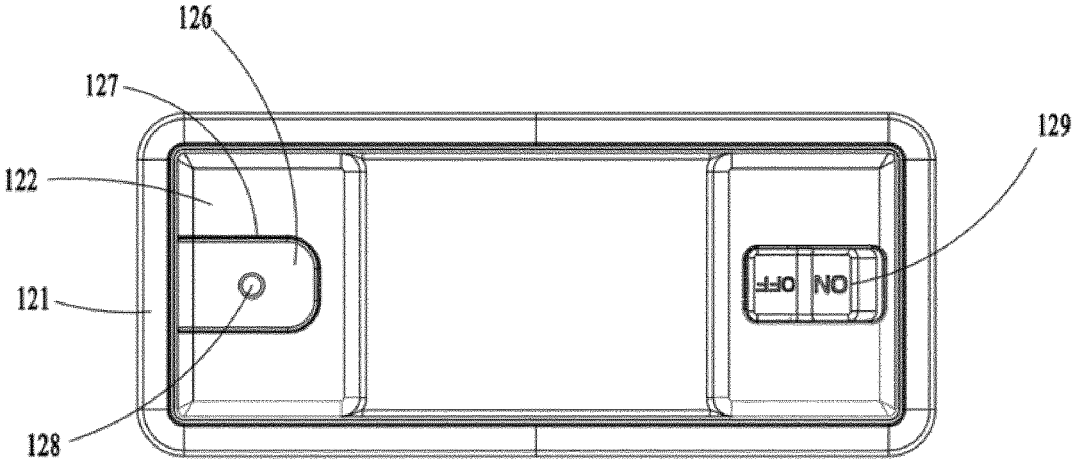
FIG. 3 is a schematic top view of a wet mopping device of the present invention.
Figure 4:
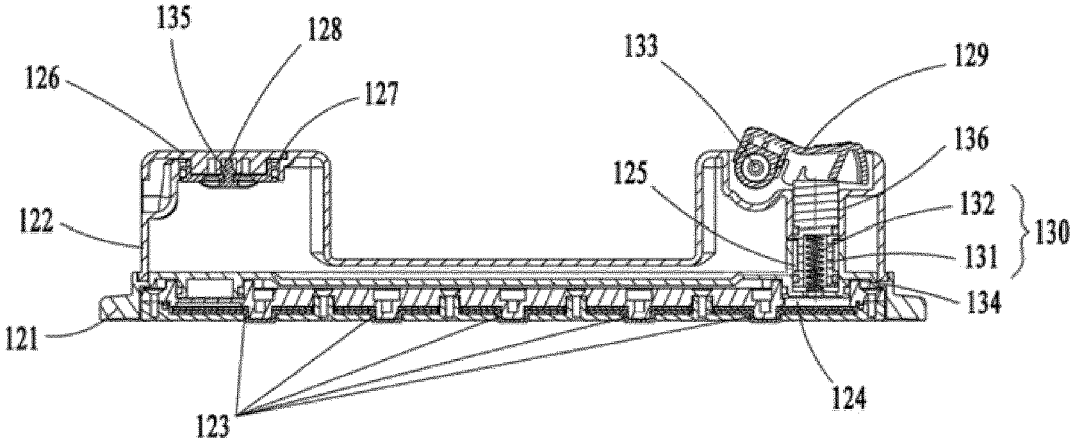
FIG. 4 is a first schematic cross-sectional structural view of the wet mopping device of the present invention (after the user operates the action member in one direction, the valve closes the liquid outlet at the bottom of the liquid supply tank)

As shown in FIGS. 3 and 4, the wet mopping device 12 comprises a base plate 121 for having mop cloth mounted thereto, and a liquid supply tank 122. A lower portion of the liquid supply tank 122 is of an opening structure, and the base plate 121 is fixedly mounted at the lower portion of the liquid supply tank 122, and closes the lower opening of the liquid supply tank 122, so that the liquid supply tank 122 and the base plate 121 enclose a liquid storage chamber. Of course, in order to facilitate injection molding, the base plate 121 and the liquid supply tank 122 may also be integrally formed.

In order to facilitate the user to add cleaning water, the wet mopping device 12 is to detachably mounted to the floor brush body 11. Specifically, the liquid supply tank 122 has two housing portions opposite each other in the left and right direction, and a connection portion connected to the two housing portions, and the connection portion is of a hollow structure and is integrally formed with the two housing portions. The space between the two housing portions forms a snap groove, and the floor brush body 11 has a snap-in portion adapted to the snap groove, such that when the wet mopping device 12 is mounted to the floor brush body 11, the snap-in portion of the floor brush body 11 is located in the snap groove of the wet mopping device 12, and the liquid supply tank 122 is located at the top of the floor brush body 11.

Of course, in order to facilitate the installation of the mop cloth, it is not necessary to completely detach the wet mopping device 12 from the floor brush body 11; instead, it is only necessary that the liquid supply tank 122 is fixed to the floor brush body 11, and the base plate 121 is detachably provided at the bottom of the liquid supply tank 122. Specifically, the base plate 121 is connected to the liquid supply tank 122 in a snap-fit manner, wherein a lower edge of a side wall plate of the liquid supply tank 122 constitutes a connection portion, the base plate 121 is provided with a connection groove arranged in a circumferential direction and adapted to the lower edge of the side wall plate of the liquid supply tank 122, and a waterproof sealing strip is provided in the connection groove.

The base plate 121 is of an inner hollow structure, and its hollow interior forms a cavity 124. A lower side wall plate of the base plate 121 is provided with a plurality of liquid discharge holes 123, the side wall plate of the liquid supply tank 122 is provided with a liquid outlet 125, and the liquid storage chamber, the liquid outlet 125, the cavity 124, and the liquid discharge holes 123 are in fluid communication with one another in sequence. In this way, the cleaning water in the liquid supply tank 122 can flow into the cavity 124 through the liquid outlet 125, and then to each of the liquid discharge holes 123 from the cavity 124. Of course, in order to facilitate the disassembly and assembly and for the convenience of cleaning, the base plate 121 may also be provided with a detachable portion in which the cavity 124 is formed.

In order to facilitate the cleaning water in the liquid storage chamber easily flowing to the number of liquid discharge holes 123, so as to guide same to the mop cloth, the liquid supply tank 122 is provided with an air inlet 128 for communicating the external environment with the internal liquid storage chamber, and a check valve 135 is installed at the air inlet 128. Specifically, the top of the liquid supply tank 122 is provided with a liquid filling port 127 through which the cleaning liquid can be filled, the liquid filling port 127 is provided with a tank cap 126, and the air inlet 128 is formed on the tank cap 126. The check valve 135 is also mounted on the tank cap 126. The check valve 135 only allows outside air to enter the liquid supply tank 122 from the outside, and does not allow the air and/or the cleaning water in the liquid supply tank 122 to escape from the interior of the liquid supply tank 122 to the outside environment. In this way, even if the liquid supply tank 122 is in an inverted state, the cleaning water in the liquid supply tank 122 cannot leak to the floor to be cleaned through the air inlet 128, thereby effectively preventing defects of secondary contamination on the floor to be cleaned when the user replaces the cleaning water.

Figure 5:
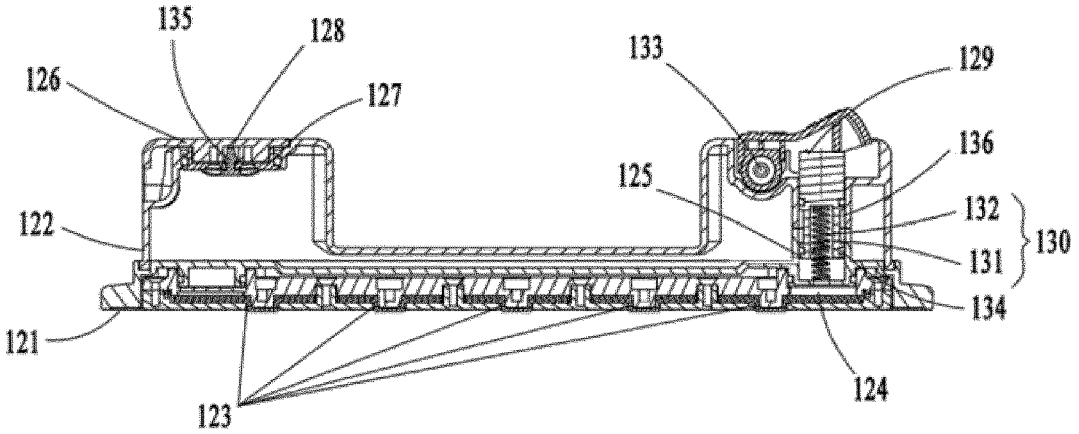
FIG. 5 is a second schematic cross-sectional structural view of the wet mopping device of the present invention (after the user operates the action member in the other direction, the valve opens the liquid outlet at the bottom of the liquid supply tank)

In order to prevent the water in the liquid supply tank 122 from being continuously guided to the mop cloth through the liquid discharge holes 123 after completing the mopping operation, which results in the excessive water content in the mop cloth, thereby leaving a large area of water stain on the floor to be cleaned. As shown in FIGS. 4 and 5, a valve 130 for opening and closing the liquid outlet 125 is installed at the liquid outlet 125, and an action member 129, which is operable by the user and is in driving connection with the valve 130, is provided at the upper portion of the liquid supply tank 122. In use, the user operates the action member 129 to drive the valve 130 to perform an action, thereby opening or closing the liquid outlet 125 on the liquid supply tank 122.

Specifically, the liquid supply tank 122 is provided with a mounting hole 136, and the valve 130 comprises a plug 131 and a spring 132 which are installed inside the mounting hole 136. One end of the spring 132 is connected to the plug 131 and the other end thereof is connected inside the mounting hole 136, and a sealing ring 134 is mounted at the lower end of the plug 131. The action member 129 is a button member, wherein one end of the button member is mounted to the liquid supply tank 122 via a rotating shaft 133, and the other end thereof constitutes a trigger portion for the user to press or step on, and the upper end of the plug 131 abuts against the button member. Of course, the action member 129 is not limited to the above-described button type rotating member, and may also be a movable member; and the structure of the valve 130 is not limited to the above-described plug 131 moving in the up and down direction, and may be a cover plate moving in the horizontal direction. For example, the movable member is fixedly connected to the cover plate, and when in use, the user operates the movable member to drive the cover plate to move in the horizontal direction, so that the cover plate and the liquid outlet 125 are offset from or aligned with each other, thereby opening or closing the liquid outlet 125.

As shown in FIG. 4, when the valve 130 is closed, the water in the liquid supply tank 122 stops flowing into the cavity 124, and the water in the cavity 124 continues to flow to the plurality of liquid discharge holes 123 until it drains.

As shown in FIG. 5, when the valve 130 is opened, the water in the liquid supply tank 122 can continuously flow into the cavity 124 through the liquid outlet 125, then flows to the plurality of liquid discharge holes 123, and is finally applied to the mop cloth to continuously wet the mop cloth. In this way, when the user is about to complete the mopping operation, the water supply of the mop cloth is not immediately interrupted, but continues to use the small amount of water in the cavity 124 to continue to wet the floor to be cleaned, thereby having a buffering function. In addition, after the water in the liquid supply tank 122 is used up, the water flow in the cavity 124 can continue to wet the mop cloth, and the mop cloth is not easily dried too fast, thereby facilitating the user adding the cleaning water in a timely manner, and reducing the transition time for the user.

FIG. 6 to FIG. 9 illustrate another embodiment of the wet mopping device 12 which includes several other aspects of the invention. It should be understood that these aspects may also be applied to the above described embodiment or combined with above described features to constitute new embodiments. In FIGS. 6-9, same reference numbers are used to designate the identical or similar parts to the embodiment shown in FIGS. 1-5.

Figure 6:
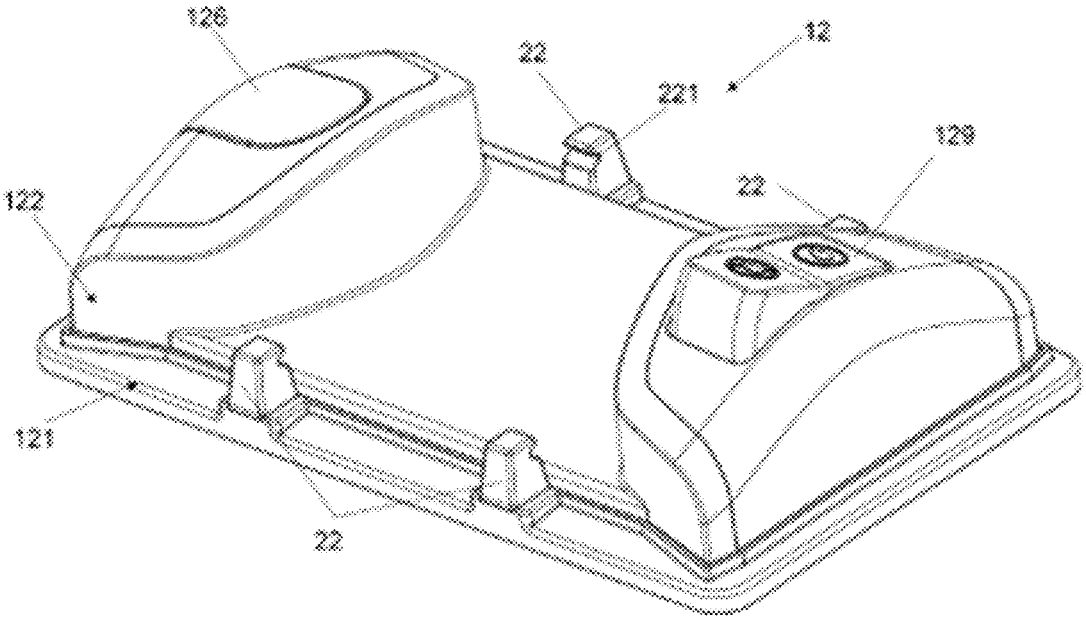
FIG. 6 is a schematic perspective view of another embodiment of the wet mopping device of the present invention.

As shown in FIG. 6, the wet mopping device 12 comprises a base plate 121 and a liquid supply tank 122, which are similar to those shown in FIG. 2. Two locking elements 22 are provided on each of the front and rear borders of the base plate 121. In the illustrated embodiment, each locking element 22 is in the form of a hook having a recess 221 facing the center of the base plate 121. The floor brush body 11 is provided with corresponding lockers respectively located on the rear surface of the front suction part and the front surface of the rear suction part (not shown in the figures). When the wet mopping device 12 is mounted to the floor brush body 11, the locker arranged on the floor brush body 11 are snapped in the recess of the locking element 22 provided on the base plate 121. This cooperation helps to ensure the fastening of the wet mopping device 12 to the floor brush body 11, in addition or in alternative to the snap fit created by the snap groove formed by the water tanks and the snap-in portion of the floor brush body 11. Moreover, the locking elements 22 also avoids that the mop cloth overlays completely the base plate 121.

Figure 7:
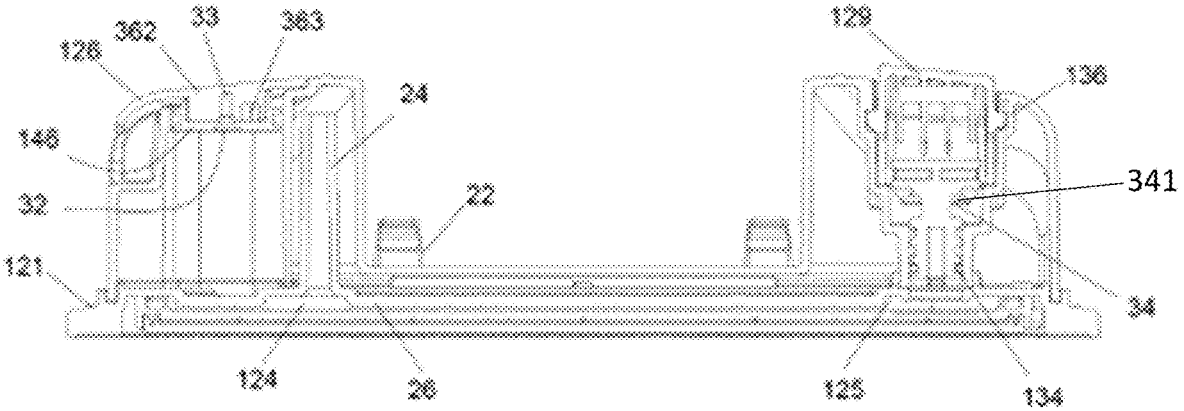
FIG. 7 is a cross-sectional structural view of the wet mopping device as shown in FIG. 6.

As shown in FIG. 7, the base plate 121 is provided a venting pipe 24 protruding from the upper surface of the base plate 121 to above the maximum filing lever of the liquid supply tank 122. The venting pipe 24 connects the cavity 124 formed inside the base plate 121 with the liquid supply tank 122. As shown in FIGS. 4, 5 and 7, the base plate 121 only has a liquid outlet 125 through which liquid exits the liquid supply tank 122 and enters the cavity 124 of the base plate 121. It could be difficult for the air trapped in the cavity 124 to get out from the liquid outlet 125 and the filling of the cavity 124 can thus be obstructed. The venting pipe allows to vent the air existing in the cavity 124 when filling the cavity 124 and thus facilitates the filling.

Also as shown in FIG. 7, the base plate 121 is provided with at least one internal wall 26, in the form of a longitudinal projection protruding from the upper surface to the inside of the cavity 124. The internal wall 26 occupies a part of the volume of the cavity 124 and thus reduces the volume of the cavity 124 that is occupied by water. Therefore, when the valve 130 is actuated to its open position, water can fill the cavity 124 more quickly and moisten the mop more quickly as well. In other words, the time response is decreased between the time the valve 130 is manually actuated and the time when the mop is moistened by water flowing from the liquid discharge holes 123. The quantity and the location of the internal walls 26 can be modified according to actual need. In addition, the internal walls 26 also serve as reinforcing elements of the base plate 121.

It can be seen from FIG. 7 that the drain valve 130 is provided with a lower sealing 134 realized by an O-ring for radial sealing and an upper sealing 34 realized by a washer with axial lip 341 for axial sealing, in order to reduce the effort needed to operate the plug 131 of the valve 130. In the embodiment illustrated on FIG. 7, the valve 130 is entirely housed in the mounting hole 136. The lower sealing 134 and the upper sealing 34 both locate between the mounting hole 136 and the plug 131 of the valve 130.

Figure 8:
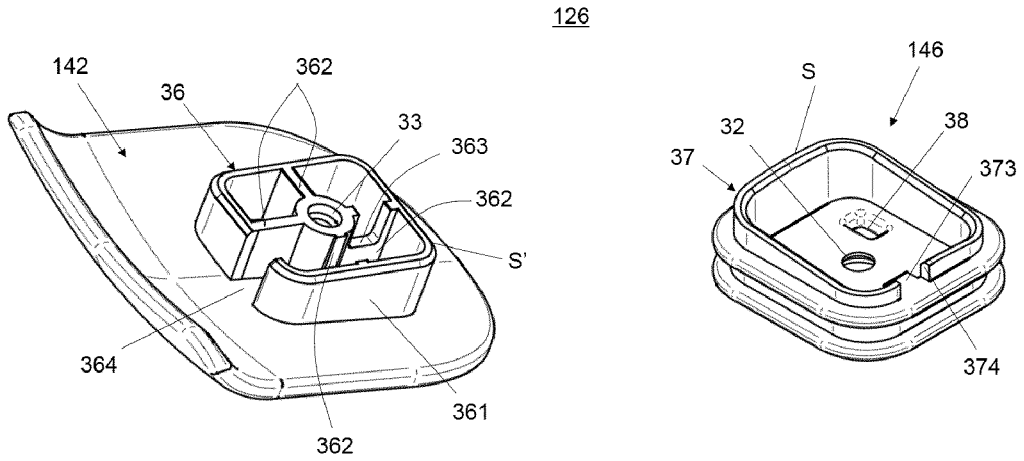
FIG. 8 is a schematic exploded view of the liquid filing part of the wet mopping device as shown in FIG. 6.
Figure 9:
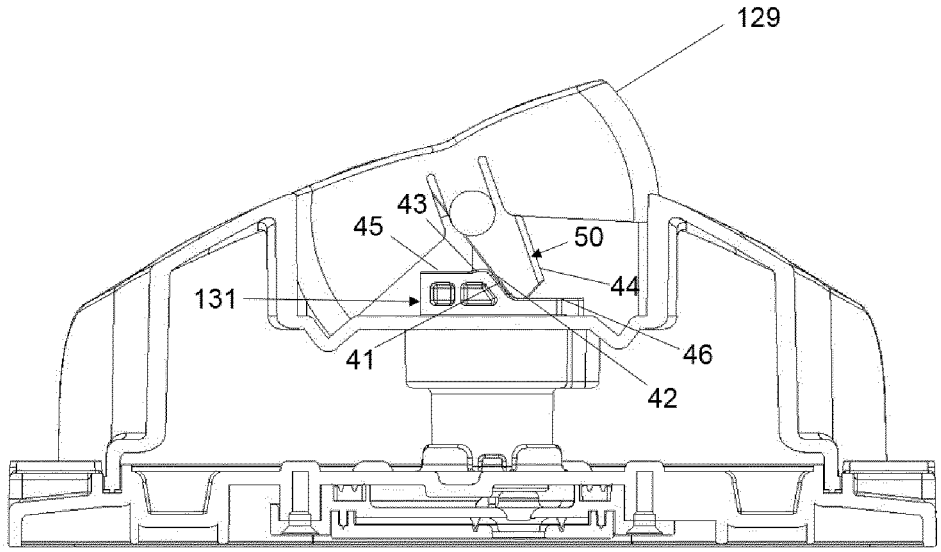
FIG. 9 is a schematic side view of the wet mopping device as shown in FIG. 6.

Different from the previous embodiments shown in FIGS. 1 to 5, in the embodiment as shown in FIGS. 6 to 8, the tank cap 126 does not comprise an air inlet orifice that is visible from outside or a check valve but defines an air inlet channel extending between an air inlet 38 open towards the interior of the liquid supply tank 122 and an air opening 364 open towards the outside of the liquid supply tank 122. The air inlet channel is formed by a chicane shape 36 formed in the tank cap 126. The tank cap 126 comprises a cover part 142 and a lining part 146 that is mounted to the cover part 142. The chicane shape is formed on the top surface of the cover part 142 and protruding downwardly therefrom. In the illustrated embodiment, the chicane shape 36 comprises an inner skirt 361 forming a substantially rectangular contour and ribs 362 linking a screw hole 33 with the inner skirt 361. The lining part 146 is mounted to the bottom of the cover part 142 and comprises a plate provided with an orifice as an air inlet 38 and an outer skirt 37 protruding upwards from the plate and surrounding the air inlet 38. The lining part 146 is for instance mounted to the cover part 142 by means of a bolt (not shown) passing through a fixing hole 32 arranged in the plate of the lining part 146 and screwed in the screw hole 33 of the cover part 142. In the illustrated embodiment, the fixing hole 32 is located in the center of the plate.

When the cover part 142 and the lining part 146 are mounted by the bolt, the outer skirt 37 is sleeved outside the inner skirt 361, with its side S facing the side S' of the inner skirt 361 as shown in FIG. 8. In addition, the height of the inner skirt 361 and the ribs 362 are dimensioned to allow them getting in contact with the plate of the lining part 146 when mounted, so that water could hardly pass through their interface with the plate of the lining part 146. As shown in FIG. 8, in this embodiment, four ribs 362 are disposed in the form of a cross with the screw hole 33 in the center. The ribs 362 form the baffles for water and/or air. It should be understood that the quantity and the distribution of the ribs may vary. When the cover part 142 and the lining part 146 are mounted, the air inlet 38 is located between two ribs 362, one of which is partially hollowed to leave an intermediate air opening 363 in the air inlet channel. Another rib adjacent to the hollowed rib is also hollowed to leave an intermediate air opening. The inner skirt 361 comprises a first notch 364 and the outer skirt 37 comprises a second notch 374 at the same location, so as to form an air opening. The first notch 364 extends on the whole height of the inner skirt 361 whilst the second notch 374 extends on a part of the height of the outer skirt 37. Preferably, as shown in FIG. 8, the outer skirt 37 comprises a block 373 protruding inwardly and is inserted in the first notch 364 of the inner skirt 361 when mounted. The first notch 364 is located between the other two ribs 362. In other words, the air inlet 38 and the air opening are located in diagonal quadrants defined by the four ribs. Thus, air entering the tank cap 126 passes firstly the air opening formed by the notches 364 and 374, then passes the intermediate air openings 363 formed in two adjacent ribs 362, and finally passes through the air inlet 38 to access the liquid tank. Conversely, when the liquid tank is tilted and the liquid tends to leak out through the tank cap 126, it is trapped between the cover part 142 and the lining part 146 by the baffles formed by the ribs 362 and the block 373. In another preferred embodiment, the intermediate air openings 363 may be located directly adjacent to the top surface of the cover part 142, so that they may trap the water more efficiently.

In order to lock the drain valve 130 in its closed or open position, a cam shape is formed at a top portion of the plug 131 of the drain valve 130. The top portion comprises a stepped surface including a higher surface 45 and a lower surface 46 which are connected by a cam surface 41. As shown on FIG. 9 wherein the drain valve 130 is in the open position, a lever arm 50 of the action member 129 rests on the lower surface 46 of the top of the plug 131. To switch the valve 130 to its closed position, the action member 129 should be rotated around its axis in the clockwise direction. The lever arm 50 of the action member 129 is thus pressed against the cam surface 41 by its first edge 42. When the cam surface 41 and the first edge 42 are being forced through, the lever arm 50 is moved downwards against a spring force that tends to urge the drain valve plug upwards and comes to rest on the higher surface 45 of the top of the plug 131 which is thus pushed down to block the liquid outlet 125. Preferably, a protrusion 43 is provided on the higher surface 45 of the top portion of the plug 131, near the cam surface 41.

Conversely, to open drain valve 130, the action member 129 should be rotated in the anticlockwise direction. The lever arm 50 is pressed against the protrusion 43 by its second edge 44. Only when the protrusion 43 and the second edge 44 are forced through, can the plug 131 be pushed upwards by the spring 132 and thus opens the valve 130.

The above embodiments are merely illustrative of the technical concept and features of the present invention, and are intended to enable those skilled in the art to understand and therefore implement the content of the present invention, and the scope of protection of the present invention could not be limited thereto. Any equivalent variations or modifications made in accordance with the spirit of the present invention shall be included within the scope of protection of the present invention.

The invention claimed is:

1. A wet-and-dry floor brush for a vacuum cleaner, comprising:

a floor brush body including at least one dust suction port at a bottom of the floor brush body; and a wet mopping device comprising a base plate for having a mop cloth mounted thereto, and a liquid supply tank located on an upper side of the base plate for supplying a cleaning liquid to the mop cloth, the base plate including a number of liquid discharge holes, and a lower portion of the liquid supply tank including a liquid outlet in fluid communication with the number of liquid discharge holes;

wherein the liquid outlet is provided with a valve for opening and closing the liquid outlet, and the liquid supply tank includes an external action member which is operable by a user, wherein the action member and the valve are disposed in a manner allowing a transmission of rotational motion such that the user is able to open or close the liquid outlet by operating the action member by applying a force on the action member toward the base plate such that the action member contacts a plug to open the valve;

wherein the base plate includes a cavity and a venting pipe connecting the cavity with the liquid supply tank, the venting pipe protruding from an upper surface of the base plate and up to above a maximum fill level of liquid in the liquid supply tank.

2. The wet-and-dry floor brush for the vacuum cleaner according to claim 1, wherein the base includes the cavity having a volume smaller than that of the liquid supply tank, and the liquid outlet, the cavity and the number of liquid discharge holes are in communication with one another in sequence.

3. The wet-and-dry floor brush for the vacuum cleaner according to claim 2, wherein the cavity includes at least one internal wall protruding inside the cavity.

4. The wet-and-dry floor brush for the vacuum cleaner according to claim 2, wherein the base plate has a detachable portion in which the cavity is formed.

5. The wet-and-dry floor brush for the vacuum cleaner according to claim 4, wherein the number of liquid discharge holes are included by the detachable portion.

6. The wet-and-dry floor brush for the vacuum cleaner according to claim 1, wherein the action member is located at a top of the liquid supply tank.

7. The wet-and-dry floor brush for the vacuum cleaner according to claim 1, wherein the wet mopping device is detachably mounted to the floor brush body.

8. The wet-and-dry floor brush for the vacuum cleaner according to claim 7, wherein the base plate includes at least one locking element which cooperates with a corresponding locker arranged on the floor brush body so as to lock the base plate with the floor brush body.

9. The wet-and-dry floor brush for the vacuum cleaner according to claim 1, wherein the base plate and the liquid supply tank are integrally formed.

10. The wet-and-dry floor brush for the vacuum cleaner according to claim 1, wherein the base plate is located at the bottom of the floor brush body, and the liquid supply tank is detachably mounted at a top of the floor brush body.

11. The wet-and-dry floor brush for the vacuum cleaner according to claim 1, wherein the base plate is detachably mounted at the bottom of the floor brush body.

12. The wet-and-dry floor brush for the vacuum cleaner according to claim 1, wherein the at least one dust suction port is exactly one dust suction port and is located at a front portion of the floor brush body, and the base plate is located behind the dust suction port.

13. The wet-and-dry floor brush for the vacuum cleaner according to claim 1, wherein the bottom of the floor brush body includes a pair of dust suction ports respectively located on a front side and a rear side of the floor brush body, and the base plate is located between the pair of dust suction ports.

14. The wet-and-dry floor brush for the vacuum cleaner according to claim 1, wherein a top of the liquid supply tank includes a liquid filling port, and a tank cap is arranged at the liquid filling port, wherein the tank cap includes an air inlet that communicates an outside with an interior of the liquid supply tank.

15. The wet-and-dry floor brush for the vacuum cleaner according to claim 1, wherein a top of the liquid supply tank includes a liquid filling port, and the cleaner includes a tank cap arranged at the liquid filling port and comprising an air inlet open towards an interior of the liquid supply tank and an air opening open towards an outside of the liquid supply tank, the tank cap comprises a chicane shape formed by at least one baffle and forming an air inlet channel extending inside the tank cap from the air inlet to the air opening.

16. The wet-and-dry floor brush for the vacuum cleaner according to claim 15, wherein the tank cap comprises a cover part and a lining part that is mounted to the cover part.

17. The wet-and-dry floor brush for the vacuum cleaner according to claim 16, wherein the cover part comprises said chicane shape.

18. The wet-and-dry floor brush for the vacuum cleaner according to claim 15, wherein at least one of the baffles is hollowed to define an intermediate air opening in the air inlet channel.

19. The wet-and-dry floor brush for the vacuum cleaner according to claim 1, wherein a cam shape is formed at a top portion of the valve to lock the valve in the closed or open position.

20. The wet-and-dry floor brush for the vacuum cleaner according to claim 1, wherein the valve includes a lower sealing formed by an O-ring for radial sealing and an upper sealing formed by a washer with an axial lip for axial sealing.

21. The wet-and-dry floor brush for the vacuum cleaner according to claim 1, wherein the action member is configured such that the force applied on the action member toward the base plate causes rotation of the action member about a rotating shaft.

* * * * *